US012385637B2

(12) United States Patent
Weaver et al.

(10) Patent No.: US 12,385,637 B2
(45) Date of Patent: Aug. 12, 2025

(54) ULTRA-LOW NOx MULTI-PORT AIR STAGED BURNER APPARATUS

(71) Applicant: Honeywell International Inc., Charlotte, NC (US)

(72) Inventors: Joshua J. Weaver, Yorktown, IN (US); Curtis L. Taylor, Paradise Valley, AZ (US)

(73) Assignee: Honeywell International Inc., Charlotte, NC (US)

( * ) Notice: Subject to any disclaimer, the term of this patent is extended or adjusted under 35 U.S.C. 154(b) by 691 days.

(21) Appl. No.: 17/677,680

(22) Filed: Feb. 22, 2022

(65) Prior Publication Data

US 2023/0266004 A1 Aug. 24, 2023

(51) Int. Cl.

| | |
|---|---|
| ***F23D 14/24*** | (2006.01) |
| ***F23C 7/00*** | (2006.01) |
| ***F23N 1/02*** | (2006.01) |

(52) U.S. Cl.

CPC ..... *F23D 14/24* (2013.01); *F23C 7/002* (2013.01); *F23N 1/02* (2013.01); *F23C 2201/20* (2013.01)

(58) Field of Classification Search

CPC ..... F23D 14/02; F23D 14/62; F23D 14/20; F23D 14/22; F23D 14/24; F23C 7/002; F23C 2201/20; F23C 2201/30; F23C 2900/03004; F23C 2900/06041; F23N 1/02

See application file for complete search history.

(56) References Cited

U.S. PATENT DOCUMENTS

| | | | | |
|---|---|---|---|---|
| 5,660,045 | A * | 8/1997 | Ito | F23D 23/00 60/737 |
| 9,188,339 | B2 | 11/2015 | Headland | |
| 10,584,051 | B2 | 3/2020 | D'Agostini et al. | |
| 10,876,731 | B2 | 12/2020 | Dolmansley et al. | |
| 10,920,979 | B2 | 2/2021 | Zink et al. | |
| 2012/0251960 | A1* | 10/2012 | Newby | F23N 5/003 431/12 |
| 2014/0147795 | A1* | 5/2014 | Tremblay | F23G 7/085 431/5 |

(Continued)

FOREIGN PATENT DOCUMENTS

| | | |
|---|---|---|
| CN | 111810951 A | 10/2020 |
| EP | 1106928 A1 | 6/2001 |
| EP | 3 617 599 A1 | 3/2020 |

OTHER PUBLICATIONS

"Reducing Combustion Emissions in Manufacturing Applications", Honeywell Thermal Solutions (UTS), 2020.

(Continued)

*Primary Examiner* — Ko-Wei Lin

(74) *Attorney, Agent, or Firm* — KPPB Law; Kermit D. Lopez; Luis M. Ortiz

(57) ABSTRACT

A burner apparatus and a method of operating the burner apparatus can include a housing and an array maintained by the housing. The burner apparatus can function according to an air staged mode of operation. The array can include a group of low-capacity fuel swirlers and low-capacity air swirlers, wherein individual or groups of the low-capacity fuel swirlers and/or low-capacity air swirlers among the array can be turned on or off based on a required burner capacity.

14 Claims, 4 Drawing Sheets

(56) References Cited

U.S. PATENT DOCUMENTS

| | | | | |
|---|---|---|---|---|
| 2015/0053124 | A1* | 2/2015 | Taniguchi | F23C 6/045 431/284 |
| 2015/0072294 | A1 | 3/2015 | Taylor et al. | |
| 2021/0122550 | A1 | 4/2021 | Weaver et al. | |

OTHER PUBLICATIONS

"LO-NOx Burner", Wikipedia, Retrieved from "https://en.wikipedia.org/w/index.php?title=LO-NOx_burner&oldid=1058075240", page last edited on Dec. 1, 2021, at 08:44 (UTC).

"Low NOx Burners", goesheatingsystems.com/low-nox-burners/, downloaded Dec. 21, 2021, Goes Heating Systems, 2019.

A.M. Elbaz and W.L. Roberts, "Air staged double swirl low NOx LPG burner", AFCR 2015 Industrial Combustion Symposium, Sep. 9-11, University of Utah, Utah.

European Application No. 23154668.0-1002, Extended European Search Report, Jul. 25, 2023.

* cited by examiner

ULTRA-LOW NOx MULTI-PORT AIR STAGED BURNER APPARATUS

TECHNICAL FIELD

Embodiments are generally related to airfuel gas burners. Embodiments also relate to burners used for industrial heating applications. Embodiments further relate to NOx burners.

BACKGROUND

Industrial manufacturers that use thermal processes are under pressure to reduce combustion byproducts, especially NOX (also referred to herein as NOX or NOx)—a collective term for nitric oxide (NO) and nitrogen dioxide ($NO_2$)—to meet tightening global emissions regulations.

Most of the NOx produced by airfuel burners used in industrial processes comes in the form of thermal NOx. Thermal NOx is strongly correlated to flame temperature and residence time at that temperature. The primary goal of low NOx burner designs is to keep local flame temperatures down. This can be accomplished in a variety of ways with high amounts of excess air, thorough fuel and air mixing, air staging etc.

Low NOx burners are the most cost-efficient way to reduce an industrial heat process's NOx emissions. A large number of low NOx burners have been developed and are currently used in industrial, plant and other applications. Nevertheless, developmental work continues to enhance the design, and improve the performance of existing burners and engineer and develop new and advanced low NOx burners.

In low NOx nozzle mix burners for gaseous fuels emissions turndown is generally much less than thermal turndown. In a business environment of tightening emissions requirements this leads to a restricted operating range if a company intends to stay in compliance. If emissions turndown could be improved for a low NOx burner, this could lead to much greater flexibility in operating ranges, and enhanced control of furnace output.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

It is, therefore, one aspect of the embodiments to provide for an improved low NOx burner apparatus.

It is another aspect of the embodiments to provide for a low NOx multi-port air staged burner apparatus.

It is a further aspect of the embodiments to provide a burner apparatus having multiple low capacity fuel and air swirlers configured in an array in which individual or groups of swirlers of the array can be turned on and off based on a required burner capacity.

It is also an aspect of the embodiments to provide a burner apparatus that uses discharge sleeves to separate the outlet of a group of swirlers from another, such that fuel can be cut off to one group of swirlers while air flow is maintained, thereby creating an air staged mode of operation for the burner apparatus.

The aforementioned aspects and other objectives can now be achieved as described herein. In an embodiment, a burner apparatus, can include a housing and an array maintained by the housing and which can function according to an air staged mode of operation. The array can comprise a plurality of low-capacity fuel swirlers and low-capacity air swirlers, wherein individual or groups of the low-capacity fuel swirlers and/or low-capacity air swirlers among the array are turned on or off based on a required burner capacity.

In an embodiment, the housing can comprise a plurality of discharge sleeves that separates an outlet from the low-capacity fuel swirlers and/or low-capacity air swirlers.

In an embodiment, fuel can be cut-off to a group among the low-capacity fuel swirlers and/or low-capacity air swirlers while a flow of air is maintained, thereby facilitating the air staged mode of operation.

In an embodiment, array can be supplied by a common fuel and air source for the fuel and the air.

In an embodiment, the fuel and the air can be directed to one or more of the low-capacity fuel swirlers and the low-capacity air swirlers at a time.

In an embodiment, the fuel and the air can be mixed, such that a combustible mixture of the fuel and the air is located downstream from the low-capacity fuel swirlers and the low-capacity air swirlers.

In an embodiment, a burner apparatus can include an array which functions according to an air staged mode of operation. The array can include a plurality of low-capacity fuel swirlers and low-capacity air swirlers, wherein individual or groups of the low-capacity fuel swirlers and/or low-capacity air swirlers among the array are turned on or off based on a required burner capacity.

In an embodiment, a method of operating the burner apparatus can involve: operating an array maintained within a housing according to an air staged mode of operation, with the array including a plurality of low-capacity fuel swirlers and low-capacity air swirlers; and turning on or off individual or groups of the low-capacity fuel swirlers and/or low-capacity air swirlers of the array based on a required burner capacity.

An embodiment of the method can further involve cutting-off fuel to a group among the low-capacity fuel swirlers and/or low-capacity air swirlers while a flow of air is maintained, thereby facilitating the air staged mode of operation.

An embodiment of the method can further involve supplying the array by a common fuel and air source for the fuel and the air; and directing the fuel and the air to at least one of the low-capacity fuel swirlers and the low-capacity air swirlers at a time.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

Like reference symbols or reference numerals in the various drawings indicate like elements.

DETAILED DESCRIPTION

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in an embodiment" or "in one embodiment" or "in an example embodiment" and variations thereof as utilized herein may or may not necessarily refer to the same embodiment. Similarly, the phrase "in another embodiment" or "in another example embodiment" and variations thereof as utilized herein may or may not necessarily refer to a different embodiment. It is intended, for example, that claimed subject matter may include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 1:
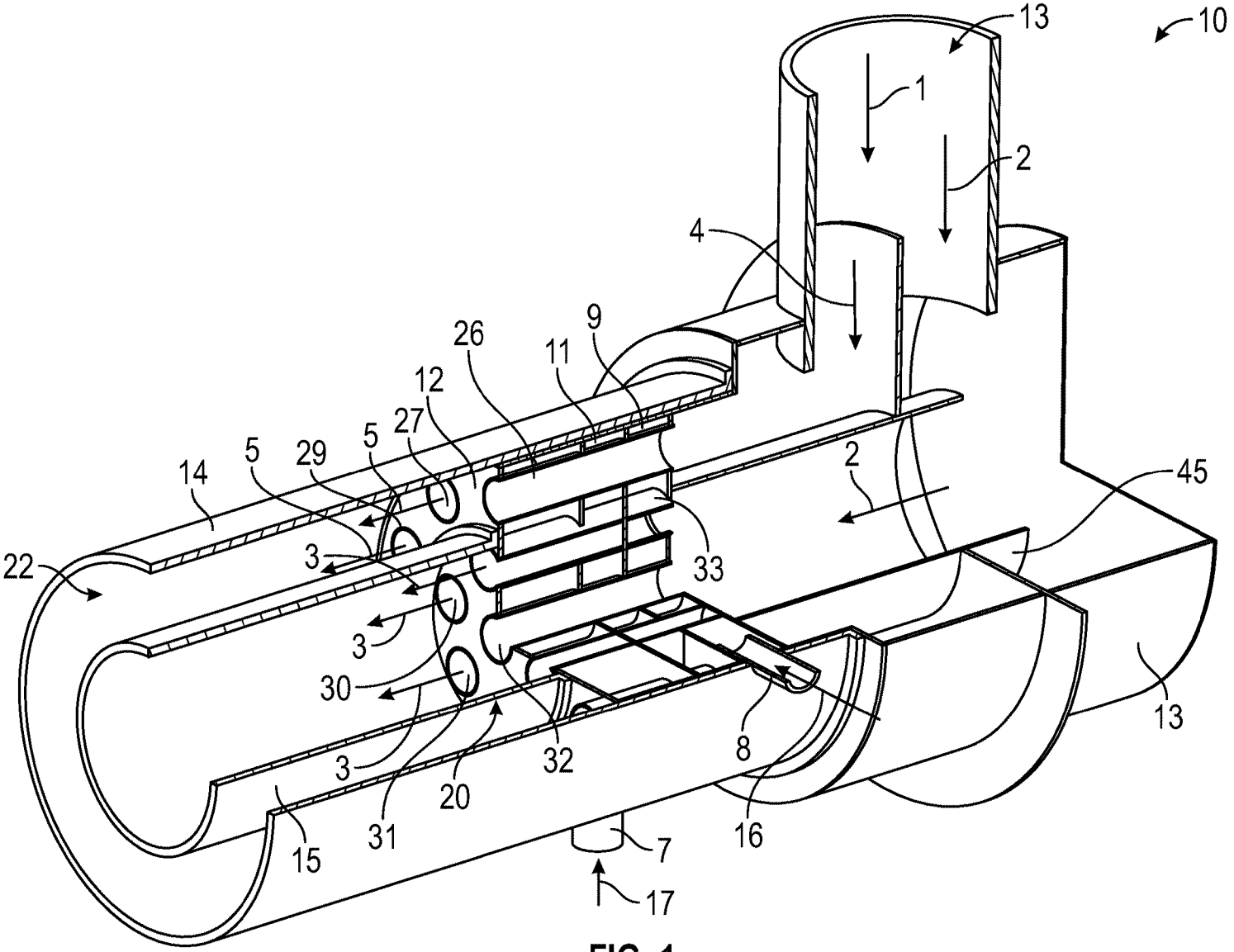
FIG. 1 illustrates a side perspective cut-away view of a burner apparatus, which can be implemented in accordance with an embodiment.
Figure 2:
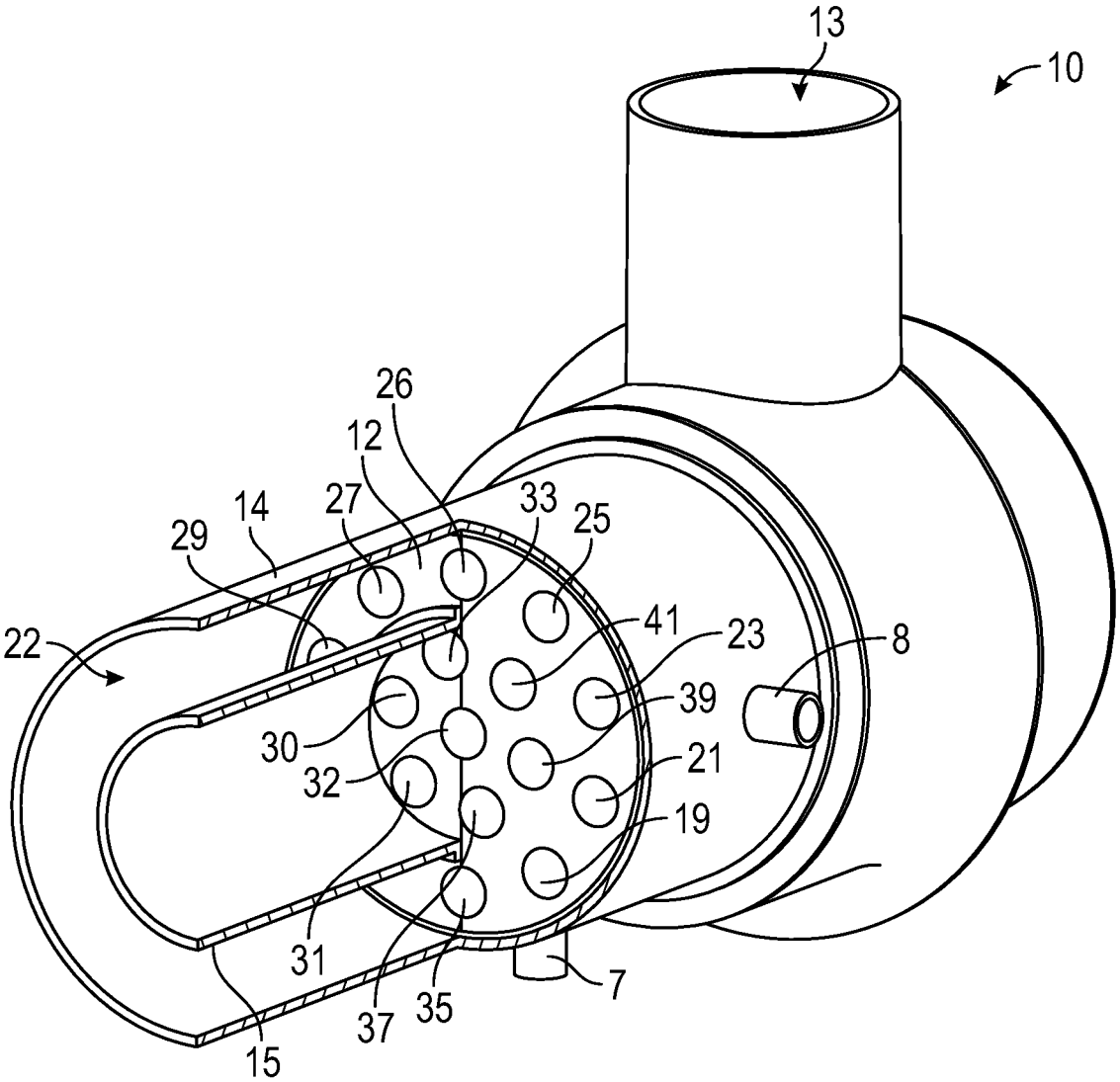
FIG. 2 illustrates a front perspective view of the burner apparatus depicted in FIG. 1, in accordance with an embodiment.

FIG. 1 illustrates a side perspective cut-away view of a burner apparatus 10, which can be implemented in accordance with an embodiment. FIG. 2 illustrates a front perspective view of the burner apparatus 10 depicted in FIG. 1, in accordance with an embodiment.

The burner apparatus 10 includes a burner housing 13 and a burner combustion air sleeve 14. In the embodiment depicted in FIG. 1 and FIG. 2, air can enter the burner apparatus 10 through an air inlet 13 as indicated by arrow 1 and can be split into flow paths indicated by arrow 2 and arrow 4. The air in the flow path indicated by arrow 2 can enter a central combustion air plenum 45 then can be split into swirler air sleeves, 30, 31, 32, 33, 37, 39, 41. The air in flow path indicated by arrow 4 thus can enter the burner housing 13 and can be then split into combustion air sleeves located in an outer ring 22 of combustion air sleeves. The burner apparatus 10 includes a center core 20 of the air sleeves 30, 31, 32, 33, 37, 39, 41 and an outer ring 22 of air sleeves 19, 21, 23, 25, 26, 27, 29, 35, etc.

The burner apparatus 10 can include a fuel inlet 7 and a fuel inlet 8. Fuel can enter the burner apparatus 10 through the fuel inlet 7 and the fuel inlet 8 as shown, respectively, arrow 17 and arrow 16. The fuel inlet 7 can lead to a fuel vessel 11 and has a path to enter the center core 20 of swirlers. The fuel inlet 8 can lead to a fuel vessel 9 and has a path to enter the outer ring 22 of swirlers. This outer ring 22 of swirlers can include, for example, the air sleeves 19, 21, 23, 25, 26, 27, 29, 35, etc. The center core 20 of swirlers can include, for example, the air sleeves 30, 31, 32, 33, 37, 39, 41. The air and fuel can be then mixed in each individual swirler. A combustible mixture of air and fuel can exit each fuel swirler and can be ignited after exiting the burner face 12 of the burner apparatus 10, for example flow paths 3 and 5.

In another mode of operation of the burner apparatus 10, the fuel flow can be cut off at the fuel inlet 8 while maintaining the air flow indicated by arrow 4. In this mode of operation, the flow path 5 may only be air. The burner apparatus can also include a discharge sleeve 14 and a discharge sleeve 15, which can separate outlets of the swirlers fed by the fuel inlet 7 from the swirlers fed by the fuel inlet 8. Discharge sleeves 14 and 15 can discharge into the application environment.

The embodiments are unique in their application of fuel and air swirlers. By arranging multiple low capacity fuel and air swirlers in an array, individual or groups of swirlers can be turned on and off based on a required burner capacity. Turndowns in the range of 40:1, for example, can become possible while still maintaining low NOx. The multiport design of the embodiments can also offer greater flexibility in operating modes. That is, as discussed in greater detail herein first, second and/or additional operating modes may be used. By using properly designed discharge sleeves that can separate the outlet of a group of swirlers from another, for example, fuel can be cut off to one group of swirlers while air flow is maintained, creating an air staged mode of operation.

The burner apparatus 10 can thus contain an array of fuel and air swirlers, which can be supplied by a common fuel and air source, whereby the fuel and air can be directed to one or many fuel and air swirlers at a time. The fuel and air swirler of the embodiments can be designed in such a way as to mix the fuel and air so that downstream of the swirler will be a combustible mixture of fuel and air. The outlets of a group of swirlers can be separated from the remaining swirlers. Fuel can be cut off to one group of swirlers and air only passed through that swirler group.

Figure 3:
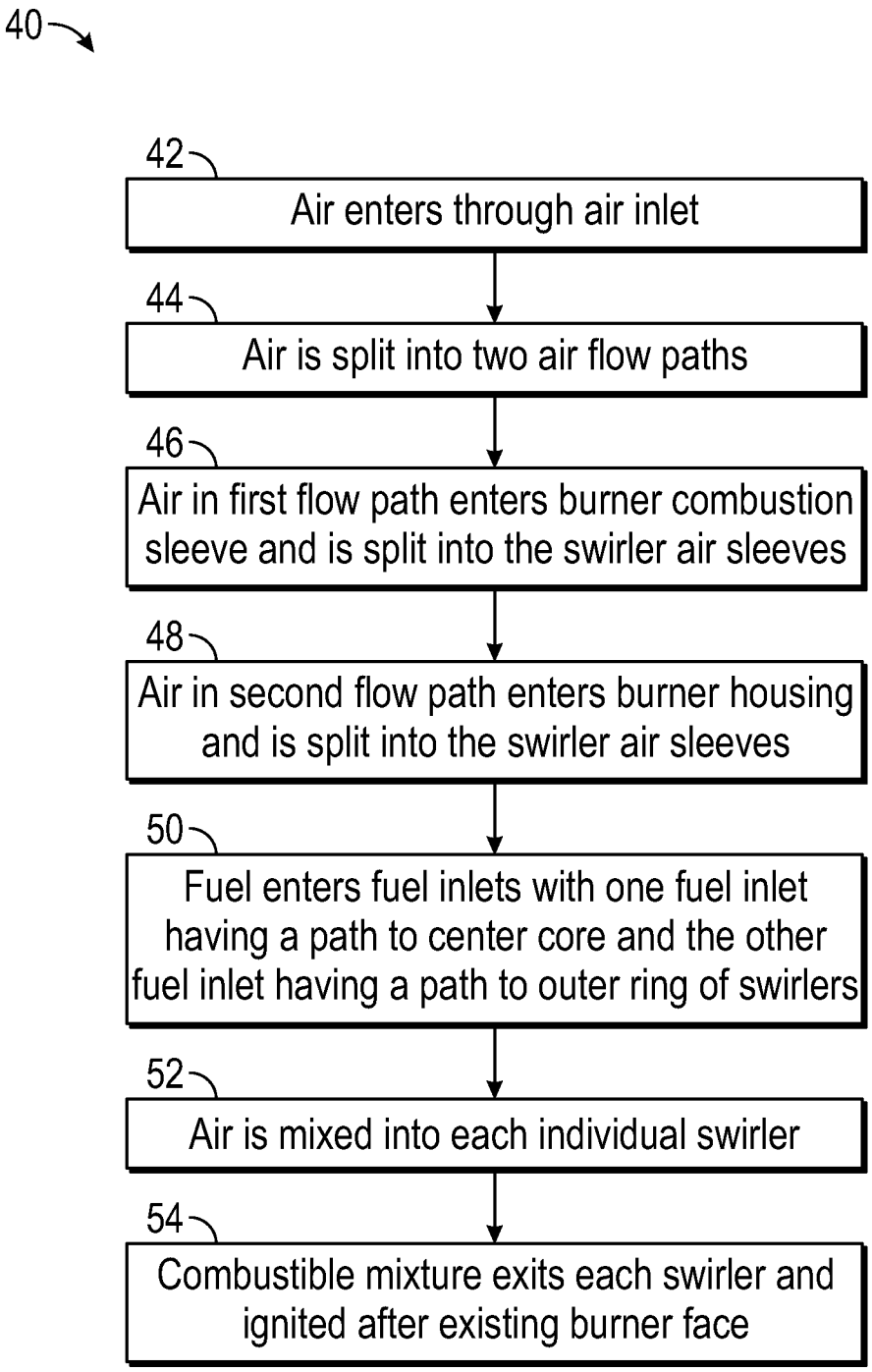
FIG. 3 illustrates a flow chart depicting steps of a method for operating the burner apparatus depicted in FIG. 1 and FIG. 2 in a first operating mode, in accordance with an embodiment.
Figure 4:
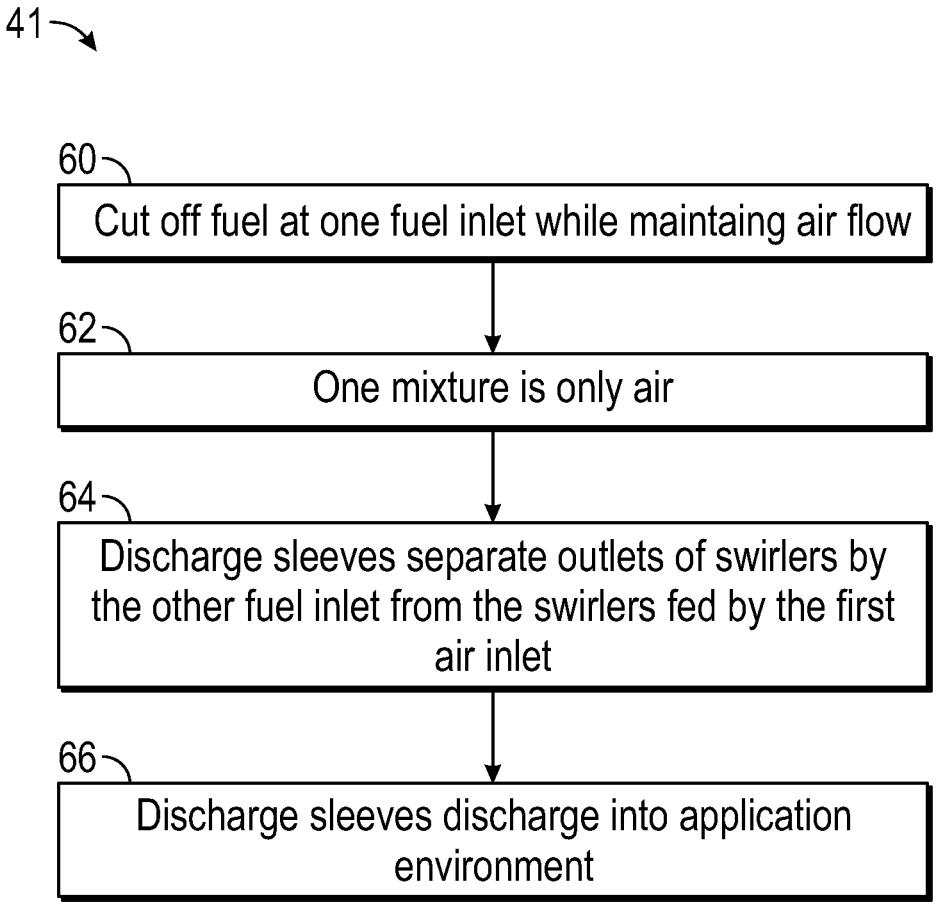
FIG. 4 illustrates a flow chart depicting steps of a method for operating the burner apparatus depicted in FIG. 1 and FIG. 2 in a second operating mode, in accordance with an embodiment.

FIG. 3 illustrates a flow chart depicting steps of a method 40 for operating the burner apparatus 10 depicted in FIG. 1 and FIG. 2 in a first operating mode, in accordance with an embodiment. It should be appreciated that the sequence of steps and operations of the method 40 shown in FIG. 3 and the method 41 shown in FIG. 4 are not limited to the particular sequence depicted in FIG. 3 and FIG. 4. That is, some steps or operations shown and described herein with respect to the blocks shown in FIG. 3 and FIG. 4 may be performed in a different sequence or even simultaneously. The specific sequence of steps or operations shown in FIG. 2 and FIG. 4 is depicted for exemplary purposes only and should not be considered as a limiting feature of the embodiments.

As shown at block 40 in FIG. 3, air can enter the burner apparatus 10 through the air inlet and can be then, as indicated at block 44, split into two flow paths. Air in the first flow path can enter the combustion air sleeve and can be split into the plurality of swirler air sleeves, as indicated at block 46. As depicted at block 48, the air in the second flow path can enters the burner housing and can be split into the plurality of swirler air sleeves. As depicted at block 50, the fuel can enter the fuel inlets of the burner apparatus 10 with one of the fuel inlets having a path to the center core of the burner apparatus 10 and the other fuel inlet having a path to the outer ring of swirlers of the burner apparatus 10. The air and fuel can be then mixed in each individual swirler as indicated at block 52. The combustible mixture of air and fuel can then exit each fuel swirler and can be ignited after exiting the burner face of the burner apparatus 10, as described at block 54.

FIG. 4 illustrates a flow chart depicting steps of a method 41 for operating the burner apparatus depicted in FIG. 1 and FIG. 2 in a second operating mode, in accordance with an embodiment. As indicated at block 60 in FIG. 4, the fuel flow with respect to the burner apparatus 10 can be cut off at one fuel inlet while maintaining the air flow indicated by arrow 4 in FIG. 1. In this mode of operation, just one mixture (e.g., mixture 50) may comprise only air, as depicted at block 62. The discharge sleeves of the burner apparatus 10 can separate the outlets of the swirlers fed by fuel inlet one fuel inlet from the swirlers fed by the other fuel inlet, as indicated at block 64. These discharge sleeves can then discharge into the application environment, as illustrated at block 66.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A burner apparatus, comprising:

a housing;

an array maintained by the housing and which functions according to an air staged mode of operation, the array comprising a plurality of low-capacity fuel swirlers and low-capacity air swirlers, wherein individual or groups of low-capacity fuel swirlers and/or low-capacity air swirlers among the array are turned on or off based on a required burner capacity; and a common fuel source and a common air source are operable to supply fuel and air to at least one of the low-capacity fuel swirlers and the low-capacity air swirlers among the plurality of low-capacity fuel swirlers and low-capacity air swirlers, and wherein the fuel and air are mixed within each swirler to form a combustible mixture.

2. The burner apparatus of claim 1, wherein the housing comprises a plurality of discharge sleeves that separates an outlet of the array from the low-capacity fuel swirlers and/or low-capacity air swirlers.

3. The burner apparatus of claim 2, wherein the fuel is cut-off to a group of swirlers among the low-capacity fuel swirlers and/or low-capacity air swirlers while a flow of the air is maintained, thereby facilitating the air staged mode of operation.

4. The burner apparatus of claim 1, wherein the combustible mixture of the fuel and the air flows downstream from the low-capacity fuel swirlers and the low-capacity air swirlers.

5. A burner apparatus, comprising:

an array which functions according to an air staged mode of operation, the array comprising a plurality of low-capacity fuel swirlers and low-capacity air swirlers, wherein individual or groups of the low-capacity fuel swirlers and/or low-capacity air swirlers among the array are turned on or off based on a required burner capacity; and a common fuel source and a common air source are operable to supply fuel and air to at least one of the low-capacity fuel swirlers and the low-capacity air swirlers among the plurality of low-capacity fuel swirlers and low-capacity air swirlers, and wherein the fuel and air are mixed within each swirler to form a combustible mixture.

6. The burner apparatus of claim 5 further comprising comprises a plurality of discharge sleeves that separates an outlet of the array from the low-capacity fuel swirlers and/or low-capacity air swirlers.

7. The burner apparatus of claim 6, wherein the fuel is cut-off to a group of the array among the low-capacity fuel swirlers and/or low-capacity air swirlers while a flow of the air is maintained, thereby facilitating the air staged mode of operation.

8. The burner apparatus of claim 5, wherein:

the combustible mixture of the fuel and the air flows downstream from the low-capacity fuel swirlers and the low-capacity air swirlers.

9. A method of operating a burner apparatus, comprising:

operating an array maintained within a housing according to an air staged mode of operation, the array comprising a plurality of low-capacity fuel swirlers and low-capacity air swirlers;

turning on or off individual or groups of the low-capacity fuel swirlers and/or low-capacity air swirlers among the array based on a required burner capacity; and supplying fuel and air by a common fuel source and a common air source to at least one of the low-capacity fuel swirlers and the low-capacity air swirlers among the plurality of low-capacity fuel swirlers and low-capacity air swirlers, and wherein the fuel and air are mixed within each swirler to form a combustible mixture.

10. The method of claim 9, wherein the housing comprises a plurality of discharge sleeves that separates an outlet of the array from the low-capacity fuel swirlers or the low-capacity air swirlers.

11. The method of claim 10 further comprising cutting-off the fuel to a group of the array among the low-capacity fuel swirlers and/or low-capacity air swirlers while a flow of the air is maintained, thereby facilitating the air staged mode of operation.

12. The method of claim 9, wherein the housing comprises a plurality of discharge sleeves that separates an outlet of the swirlers from the low-capacity fuel swirlers and low-capacity air swirlers.

13. The method of claim 9 wherein the combustible mixture of the fuel and the air-flows downstream from the low-capacity fuel swirlers and the low-capacity air swirlers.

14. The method of claim 9 further comprising facilitating the air staged mode of operation by cutting-off fuel to a group of swirlers among the low-capacity fuel swirlers and/or the low-capacity air swirlers while a flow of the air is maintained.

* * * * *